US005400480A

United States Patent [19]

Futch, III

[11] Patent Number: 5,400,480

[45] Date of Patent: Mar. 28, 1995

[54] DEVICE FOR ATTACHING AN ARTICLE OF CLOTHING

[76] Inventor: James M. Futch, III, 4840 Swinton Creek, Hollywood, S.C. 29449

[21] Appl. No.: 168,663

[22] Filed: Dec. 16, 1993

[51] Int. Cl.[6] ..... A44B 19/00

[52] U.S. Cl. ..... 24/387; 24/419; 24/429

[58] Field of Search ..... 24/387, 419, 429, 370, 24/390

[56] References Cited

U.S. PATENT DOCUMENTS

| | | | |
|---|---|---|---|
| 2,087,045 | 7/1937 | Roberts et al. | 24/390 |
| 2,111,924 | 3/1938 | Etten | 24/387 |
| 2,591,193 | 4/1952 | Perry | 24/387 |
| 2,656,579 | 10/1953 | Wilson | 24/387 |
| 2,675,559 | 4/1954 | Miller | 24/387 |
| 2,681,492 | 6/1954 | Lackritz | 24/429 |
| 3,255,503 | 6/1966 | Sozzi | 24/387 |
| 4,928,363 | 5/1990 | Easton | 24/429 |

FOREIGN PATENT DOCUMENTS

| | | | |
|---|---|---|---|
| 1144678 | 3/1969 | United Kingdom | 24/387 |

*Primary Examiner*—Victor N. Sakran
*Attorney, Agent, or Firm*—B. Craig Killough

[57] ABSTRACT

A zipper is provided with a stem which is attached in a fixed manner to a trolley of the zipper. The stem is provided with a head which engages a fastener, such as a snap, so that the zipper is held closed by the engagement of the stem with the fastener. The article of clothing, such as the fly of a pair of pants, or other article, is fastened by the zipper and the fastener, and the engagement of the zipper and the fastener.

5 Claims, 3 Drawing Sheets

DEVICE FOR ATTACHING AN ARTICLE OF CLOTHING

FIELD OF THE INVENTION

This invention relates to fasteners for clothing, and is more particularly directed to a combination of a zipper and a snap or button for fastening clothing or other textile or similar articles.

BACKGROUND OF THE INVENTION

Most articles of clothing employ means for connecting edges of the clothing to allow the clothing to be properly worn. Such means for fastening or connecting clothing includes, buttons, snaps, laces, and hook and loop material.

Typically, one edge of the clothing article is connected to another edge of the clothing article to allow the article to be worn with the proper fit. Shirts are typically buttoned by inserting a button attached to one edge through a button hole formed in an opposite edge. Coats, jackets, slacks, and other articles are similarly formed.

Some articles of clothing use zippers, which are attached to opposite edges of the clothing to be joined. Zippers have a trolley which joins the zipper. The tracks of the zipper are attached to each edge of the clothing to be joined. When the trolley is pulled in one direction, the zipper is separated, separating of the edges of the clothing, and when the trolley is pulled in an opposite direction, the tracks are joined, joining the edges of the clothing.

Pants and jackets are common examples of clothing which use zippers. Most pants use a button, snap or other fastener conjunction with a zipper. The fastener is placed near one end of the zipper.

In most pants, a zipper is present in what is known as a fly. The fly is joined in a fixed manner at one end, which is usually the bottom of the fly, and is open at an opposite end. A zipper is commonly used to allow the opposite edges of the fly to be joined from one end, to an opposite end, by moving the trolley along the zipper so as to cause the zipper to join the fabric from bottom to top. At the top, a button or snap is used in conjunction with the zipper to hold the fabric together at the top of the opening.

In the prior art, the zipper trolley has a tab which extends from the trolley. The tab may be pivoted from a position which is parallel to the line of travel of the trolley, to an outward position, which aids the user in moving the trolley as desired. When the tab is in the position parallel to the line of movement of the trolley, it is provided with a mechanism which locks the zipper in place.

SUMMARY OF THE PRESENT INVENTION

The present invention provides a fastener for clothing. The fastener uses a zipper in combination with another fastener, which could be a snap or button, wherein the snap or fastener is used to hold the zipper is a closed position. The present invention has a stem which extends from the trolley parallel to the line of travel of the trolley. The stem is fixed, extending from the trolley toward the button or snap. The stem is larger than the stem of the trolleys found in the prior art, and allows the trolley to be moved by means of pulling or pushing the stem. Once the zipper causes the opening of the article of clothing to be closed, a snap or button communicates with the stem, such as by snapping a snap to the stem, or by buttoning through the stem, to hold the article of clothing and the zipper in place.

DETAILED DESCRIPTION OF THE DRAWINGS

DESCRIPTION OF THE PREFERRED EMBODIMENT

Figure 1:
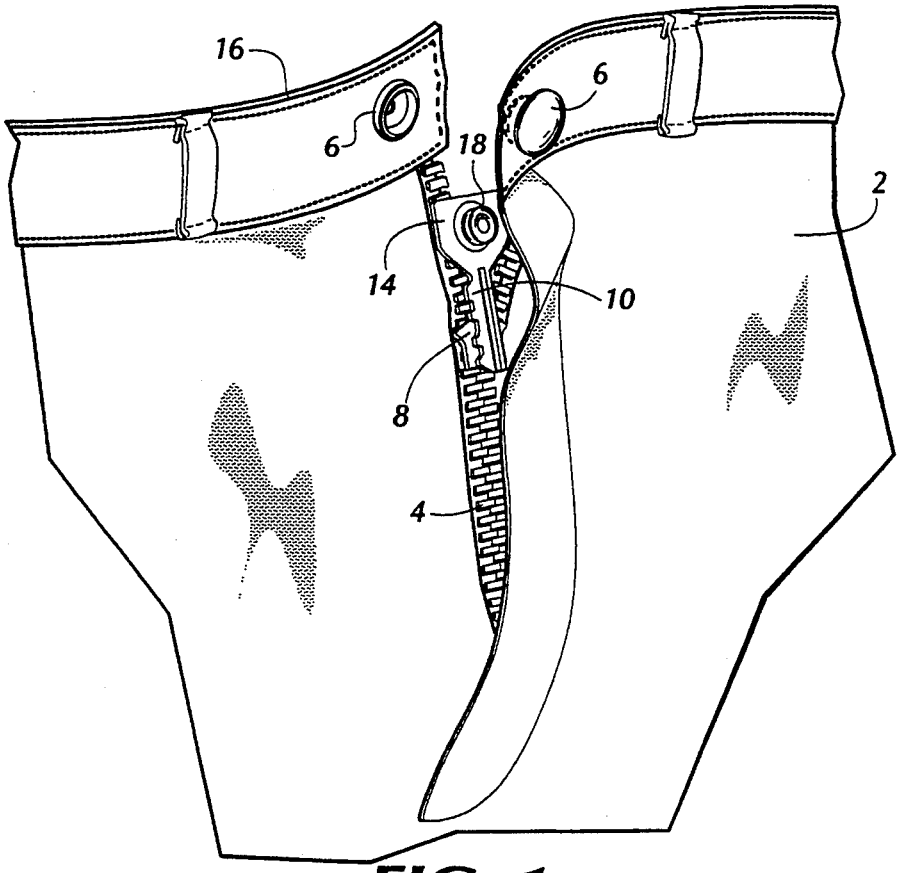
FIG. 1 is a partial view showing the fastening device.

Referring now the drawing figures, a pair of pants 2 having a zipper 4 and a fastener 6 is shown for demonstration purposes. Virtually any article of clothing, or any textile or fabric or other sheet of material which is capable of being joined by means of a zipper could be used. Zipper 4 is opened and closed by means of a trolley 8 which runs along the track of the zipper. As demonstrated in the drawing figures, as the trolley moves upward, the track is joined, mating the edges of the fabric. As the trolley moves downward, the tracks are separated, separating the edges of the fabric.

The area of the fabric which is joined in pants of the type shown in the drawing figures is known as a fly. As the trolley of the zipper moves upwardly, the zipper is joined and the fly is closed, and as the trolley moves downwardly, the zipper is separated and the fly is opened.

The trolley has a stem 10 attached to it. The stem is attached to the trolley in a fixed manner, that is, the stem does not pivot. The stem extends from the trolley in the direction in which the trolley moves to join the zipper. As shown in the preferred embodiment, the stem extends from the trolley on a line which is parallel to the line of travel of the zipper.

In the preferred embodiment, the head 14 of the stem is enlarged relative to the remainder of the stem and the point of attachment of the stem to the trolley. This enlarged head allows the user to conveniently hold and pull, or push, the stem, while also allowing interaction between the fastener and the stem.

A fastener is provided on at least one end of an opening of the pants or other article to be joined. In the embodiment shown in the drawing figures, the fabric is joined by sewing or the like at one end of the fly, and the opposite end of the fly is open. A snap or button is provided at the open end of the fly.

Figure 2:
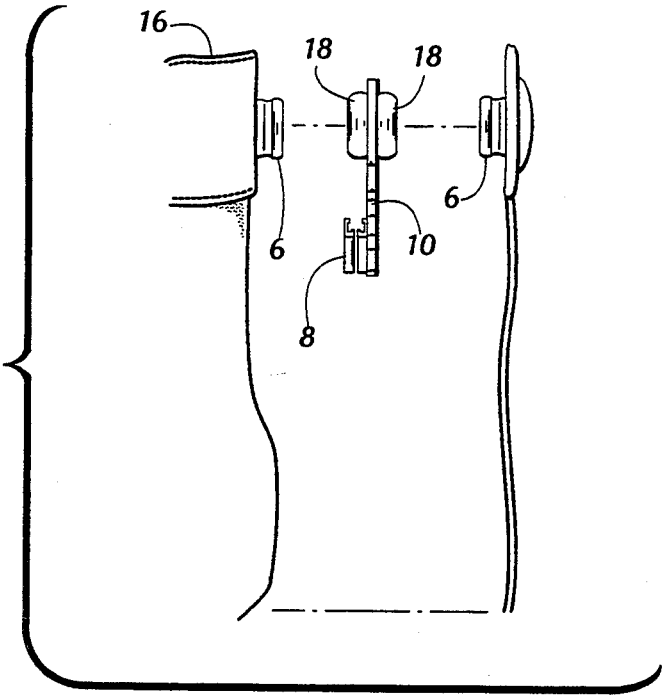
FIG. 2 is an exploded view of the fastening device shown in FIG. 1, demonstrating the engagement of the stem and the fastener.

In the embodiment shown in FIGS. 1 and 2, a female snap 6 is provided on each of the two ends of the waistband 16 of the pants to be joined. A male snap 18 is affixed to each side of the head of the stem. Each female snap is attached to the corresponding male snap after the stem is pulled upward, as is demonstrated in FIG. 2. A male snap could be placed on one or both ends of the waistband, as long as its corresponding snap on the head of the stem is female.

Figure 3:
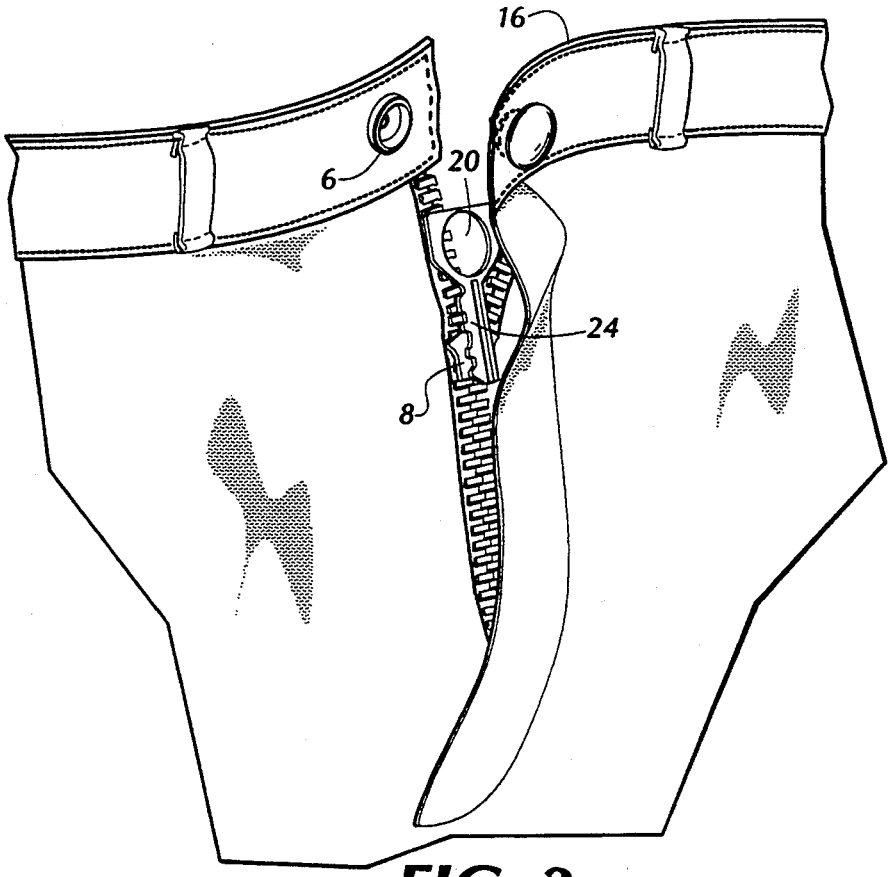
FIG. 3 is a partial view showing the fastening device.
Figure 4:
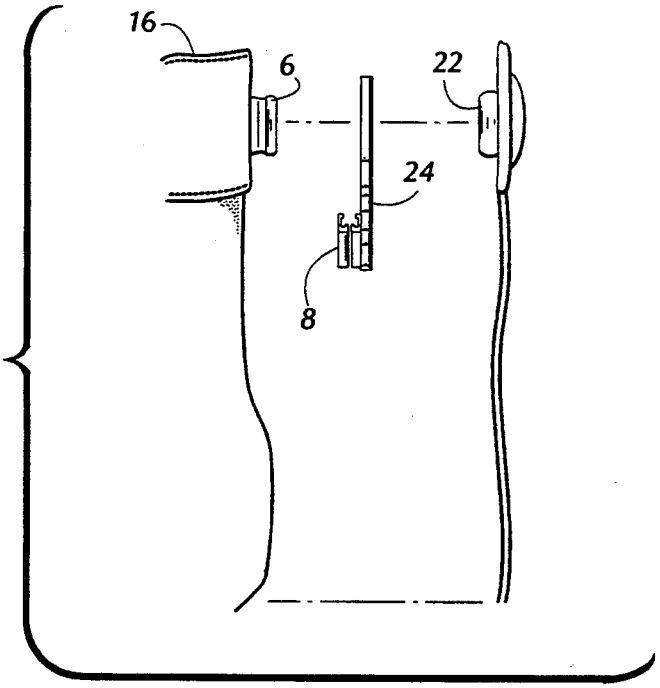
FIG. 4 is an exploded view of the fastening device shown in FIG. 3, demonstrating the engagement of the stem and the fastener.

A snap is also provided on each end of the waistband 16 as shown in FIG. 3. In this embodiment, however, the snap snaps through a void 20 in the head of the stem. A male snap 22 is provided on one end of the waistband, and a corresponding female snap 6 is provided on the other end of the waistband. The stem of the trolley 8 is pulled upward to close the fly by means of the zipper, and the snap is inserted through the void in the head of the stem, with the snap holding the stem and trolley in place to secure the closure of the zipper. The void within the stem must be of sufficient size to allow the snap to pass through it, while being sufficiently closed about its perimeter to prevent the stem from becoming disengaged from the snap.

Figure 5:
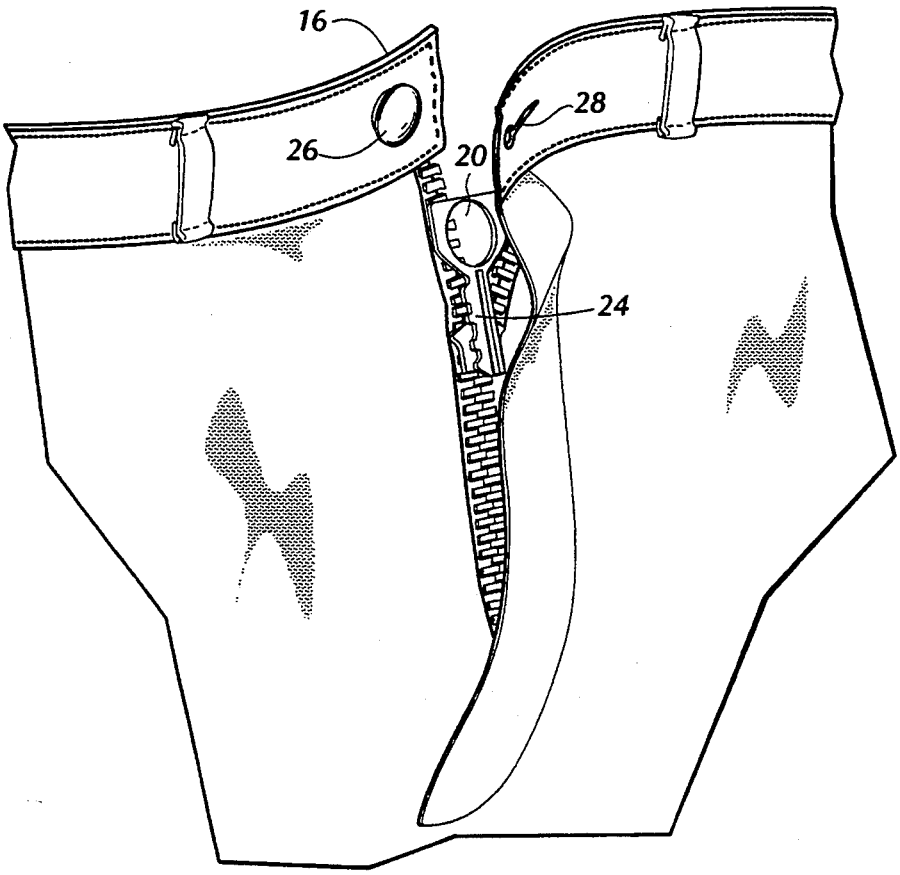
FIG. 5 is a partial view of the fastening device.
Figure 6:
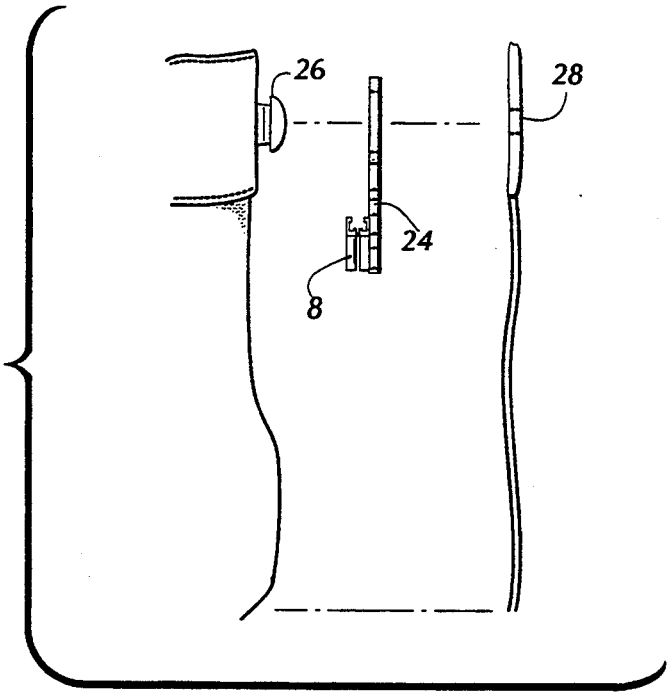
FIG. 6 is an exploded view of the fastening device shown in FIG. 4, demonstrating the engagement of the stem and the fastener.

In the embodiment shown in FIG. 5, the button and buttonhole are used instead of a snap. Stem 24 corresponds to the structure shown in FIG. 3. The button 26 of the embodiment shown in FIGS. 5 and 6 is inserted through void 20 in the head of the stem in the same manner as the embodiment shown in FIG. 6. Button 26 is inserted through the void 20 of the stem, and through buttonhole 28, with the button holding the two ends of the waistband 16 together, and holding the stem and trolley in place to secure the zipper.

In use, the zipper functions as any zipper in the prior art, excepting that the stem or tab which is attached to the trolley is not capable of pivoting. The stem or tab as used in the prior art is capable of pivoting, so as to lock the zipper in place, or to allow the tab to be pivoted for pulling to move the trolley along the zipper. The stem of the present invention is fixed, and the zipper is retained in the closed position by means of the fastener, which may be a snap or button or similar device.

In use, the trolley is moved to open or close the zipper as desired. As the zipper is moved to the closed position, the stem is moved to a position to engage the fastener. The fastener is attached to one of the end of the opening of the fabric, and engages the stem and the corresponding fastener to close the opening of the fabric, and to hold the zipper in place by holding the stem and trolley in place.

The stem may be in the shape of a key. A key provides a slender neck and foot which may be conveniently attached to the trolley, while also providing a large head for engagement with the fastener. It is desired that the foot of the stem may be no wider than the width of the trolley, and the neck of the stem be no wider than the width of the track of the zipper after the zipper is closed. The head of the stem must be sufficiently large to allow a mounting of a snap, or to allow a snap or button to be placed through a void in the head of the stem.

What is claimed is:

1. A device for joining edges of an article of clothing, comprising:

a. a zipper which is attached to opposing edges of an article which are to be joined;

b. at least one fastener which is attached to said article near one end of said zipper;

a trolley which joins and separates said zipper and said edges; and d. a stem which is attached in a fixed manner to said trolley, and which extends from said trolley generally parallel to a line of travel of said trolley and generally parallel to the zipper as the zipper joins, and which extends from said trolley toward said fastener;

wherein said fastener attaches to an end of said stem which is opposite a point of attachment of said stem to said trolley, so as to join said opposing edges of said article.

2. A device for fastening an article of clothing as described in claim 1, wherein said stem has a fastener on at least one side thereof which engages one or more fasteners affixed to said clothing.

3. A device for fastening an article of clothing as described in claim 1, wherein said stem has a void therein which engages said fastener.

4. A device for joining edges of an article of clothing, comprising:

a. a zipper which is attached to opposing edges of an article which are to be joined;

b. at least one fastener which is attached to said article near one end of said zipper;

c. a trolley which joins and separates said zipper and said edges;

d. a stem which is attached in a fixed manner to said trolley, and which extends from said trolley generally parallel to a line of travel of said trolley and toward said fastener; and e. a head which is located on an upper end of said stem which is opposite said trolley, wherein said head is enlarged relative to said stem and said trolley, and wherein said fastener attaches to at least one side of said head.

5. A device for joining edges of an article of clothing, comprising:

a. a zipper which is attached to opposing edges of an article which are to be joined;

b. a first female fastener which is attached to said article near one end of said zipper on an edge of said article near an upper end of said zipper;

c. a second female fastener which is attached to said article near one end of said zipper on an edge of said article which is opposite the edge to which first female fastener is attached, and near an upper end said zipper;

d. a trolley which joins and separates said zipper and said edges;

e. a stem which is attached in a fixed manner to said trolley, and which extends from said trolley generally parallel to a line of travel of said trolley and toward said fastener; and f. a head which is located on an upper end of said stem which is opposite said trolley, wherein said head is enlarged relative to said stem and said trolley, and wherein at least one male fastener is attached to each side of said head, wherein each of said male fasteners engages either said first female fastener or said second female fastener so as to join said edges to said head.

* * * * *